US009746183B2

(12) United States Patent
Gasparini

(10) Patent No.: US 9,746,183 B2
(45) Date of Patent: Aug. 29, 2017

(54) IGNITER WITH PILOT FLAME, PARTICULARLY FOR GAS-FIRED BURNERS

(71) Applicant: A.R.C. S.R.L., Campodarsego (IT)

(72) Inventor: Loris Gasparini, Campodarsego (IT)

(73) Assignee: A.R.C. S.R.L., Campodarsego (IT)

( * ) Notice: Subject to any disclaimer, the term of this patent is extended or adjusted under 35 U.S.C. 154(b) by 286 days.

(21) Appl. No.: 14/410,139

(22) PCT Filed: Jun. 26, 2013

(86) PCT No.: PCT/EP2013/063406
§ 371 (c)(1),
(2) Date: Dec. 22, 2014

(87) PCT Pub. No.: WO2014/001396
PCT Pub. Date: Jan. 3, 2014

(65) Prior Publication Data

US 2015/0323181 A1 Nov. 12, 2015

(30) Foreign Application Priority Data

Jun. 29, 2012 (IT) ..... PD2012A0211

(51) Int. Cl.
*F23Q 3/00* (2006.01)
*F23Q 9/04* (2006.01)

(52) U.S. Cl.
CPC ..... *F23Q 9/045* (2013.01); *F23Q 3/00* (2013.01); *F23Q 9/04* (2013.01)

(58) Field of Classification Search
CPC ..... F23Q 9/045; F23Q 3/00; F23N 2027/22
(Continued)

(56) References Cited

U.S. PATENT DOCUMENTS 2,544,930 A 5/1944 Malek
3,143,164 A 8/1964 Grohall
(Continued)

FOREIGN PATENT DOCUMENTS

CN 2171781 Y 7/1994
CN 202188527 U 4/2012
GB 1356255 6/1974

OTHER PUBLICATIONS

CN Office Action issued Oct. 27, 2015 re: Application No. 201380034014.9; pp. 1-7; citing: CN2171781Y, and CN202188527U GB1356255A.
(Continued)

*Primary Examiner* — Avinash Savani
(74) *Attorney, Agent, or Firm* — Cantor Colburn LLP

(57) ABSTRACT

An igniter with pilot flame, particularly for gas-fired burners, comprising a Venturi tube provided, at the part where the combustible mix exits, with a cap which is fitted detachably and with play on an end portion thereof, and is provided with at least one hole, which is transverse to the end portion, for the outflow of the combustible mix; the Venturi tube comprising two portions: a first portion, at the end of which the cap is present, and a second portion, by means of which it is associated with a gas source, which is extended laterally with respect to an intermediate region of the first portion, the first portion further having, on the opposite side with respect to the exit side of the combustible mix, a removable plug.

6 Claims, 4 Drawing Sheets

(58) Field of Classification Search
USPC ..... 431/281, 75, 203, 115
See application file for complete search history.

(56) References Cited

U.S. PATENT DOCUMENTS

| | | | | | |
|---|---|---|---|---|---|
| 3,297,074 | A * | 1/1967 | Murphy | F23Q 9/045 | 239/543 |
| 3,692,016 | A * | 9/1972 | Stikkers | E01B 7/24 | 126/271.2 B |
| 5,927,963 | A * | 7/1999 | Wolcott | F23N 5/20 | 431/264 |
| 6,139,311 | A | 10/2000 | Bowman | | |
| 2006/0199124 | A1 | 9/2006 | Lyles | | |

OTHER PUBLICATIONS

International Search Report for corresponding application PCT/EP2013/063406 filed Jun. 26, 2013; Mail date Aug. 23, 2013.
Written Opinion for corresponding application PCT/EP2013/063406 filed Jun. 26, 2013; Mail date Aug. 23, 2013.

* cited by examiner

IGNITER WITH PILOT FLAME, PARTICULARLY FOR GAS-FIRED BURNERS

The present invention relates to an igniter with pilot flame, particularly for gas-fired burners.

Currently, some commercially available burners are provided with an igniter with pilot flame that consists of a small secondary burner that is fitted as an aid to the ignition of the main burner and for monitoring the correct operation of the latter.

The pilot flame of the secondary burner is ignited manually or by means of a piezoelectric ignition device and the burner proper can also be provided with a thermocouple that detects the presence or absence of the pilot flame. If there is no thermocouple, the pilot flame has the function of simplifying the ignition of the main burner, allowing with a single ignition of the pilot flame (manual or piezoelectric ignition) repeated ignitions of the main burner.

If a thermocouple is associated with the pilot flame, it detects the presence of said flame and keeps open a valve that allows the flow of gas to the main burner. If the pilot flame is extinguished, for example due to a spillage of liquids or to a malfunction, the thermocouple detects a reduction in the temperature and actuates the closure of the valve, thus blocking the delivery of gas to the main burner.

During the operation of the main burner, the pilot flame remains always on except for problems, which the system manages in the manner described above.

Accordingly, if the pilot flame is extinguished and if a thermocouple is present the operation of the main burner is completely prevented.

One of the main causes of extinguishing of the pilot flame is the blocking of the orifices of the flame separator of the pilot or of the Venturi tube as a consequence of the deposition of particles of detergents used to clean the burner or of solid particles that deposit over time or due to the spillage of liquids.

Another possible cause of extinguishing is linked to the air currents that can strike the pilot flame during use of the main burner.

The aim of the present invention is to provide an igniter with pilot flame that allows to prevent the accidental extinguishing or failure to operate of the pilot flame.

Within this aim, an object of the invention is to propose a pilot flame device that can be cleaned easily of the dirt particles that can block the parts crossed by the gas.

Another object of the invention is to hinder the passage of dirt from the flame separator of the pilot flame to the Venturi tube.

A further object of the invention is to prevent the extinguishing of the pilot flame as a consequence of air currents.

This aim, as well as these and other objects that will become better apparent hereinafter, are achieved by an igniter with pilot flame, particularly for gas-fired burners, characterized in that it comprises a Venturi tube provided, at the part where the combustible mix exits, with a cap which is fitted detachably and with play on an end portion thereof, from which said cap is spaced axially, at least one hole being provided on said cap and being transverse to said end portion, for the outflow of said combustible mix, and the orientation of said cap with respect to said end portion being such that said pilot flame affects the flow of the combustible mix that exits from the flame separator of said gas-fired burner and ignites it, said Venturi tube comprising a first portion, at the end of which said cap is present, and a second portion, by means of which it is associated with a gas source, which is extended laterally with respect to an intermediate region of said first portion, said first portion having, on the opposite side with respect to the exit side of said combustible mix, a removable plug.

Further characteristics and advantages of the invention will become better apparent from the description of two preferred but not exclusive embodiments of the device according to the invention, illustrated by way of nonlimiting example in the accompanying drawings, wherein.

Figure 1:
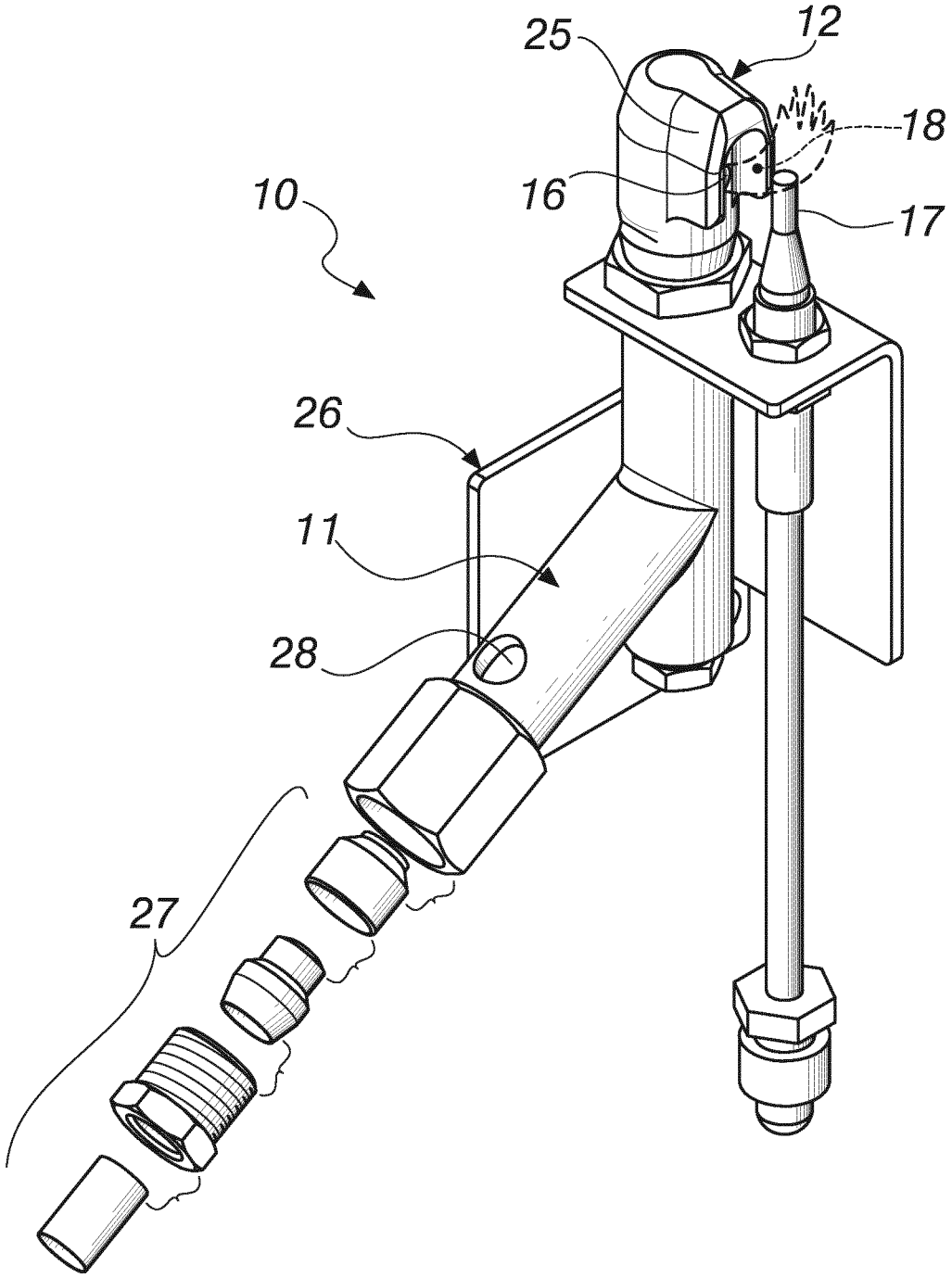
FIG. 1 is a perspective view of the device according to the invention in a first embodiment thereof.
Figure 2:
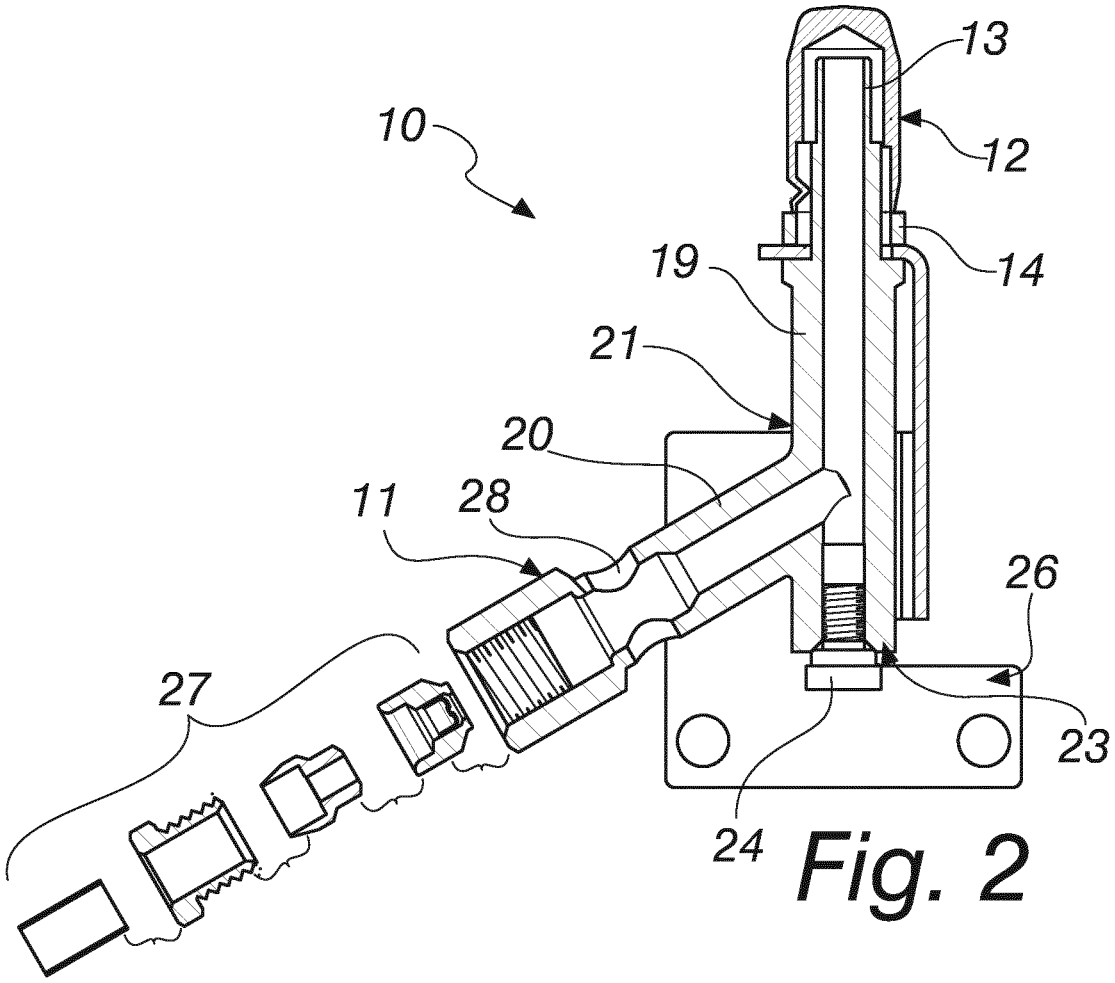
FIG. 2 is a sectional side view of the device according to the invention, again in the first embodiment.

With reference to the figures, the device according to the invention, generally designated by the reference numeral 10 in the first embodiment, comprises a Venturi tube 11, which ends at the part where the mix of gas and oxidizer exits with a cap 12 that is fitted removably and with play on an end portion 13 thereof.

In particular, a tapering of the end portion 13 causes its dimensions to be small enough with respect to those of the cavity of the cap 12 so that an interspace 15 for the passage of the mix is present between the two.

Two holes 16 are provided in the cap 12 and are transverse to the end portion 13 for the outflow of the combustible mix and are faced by a thermocouple 17; the pilot flame 18 forms from them. The two holes 16, in this embodiment, are mutually aligned in the same longitudinal direction of extension as the end portion 13.

The cap 12 is fitted so as to rest on an underlying shoulder 14 of the Venturi tube 11 and is thus spaced axially from the end portion 13, creating for the combustible mix a complex path A, i.e., a siphon-shaped path.

The orientation of the cap 12 with respect to the end portion 13 is such that the pilot flame 18 affects the thermocouple 17 and simultaneously the flow of the combustible mix 22 that exits from the flame separator 30 of the gas-fired burner 29, so as to ignite it.

The device 10 described here is provided with a thermocouple 17; however, in other embodiments the thermocouple might not be present.

In particular, the orientation of the cap 12 is defined by positioning means 31 that are further intended to prevent its rotation with respect to the end portion 13 on which it is fitted.

Figure 4:
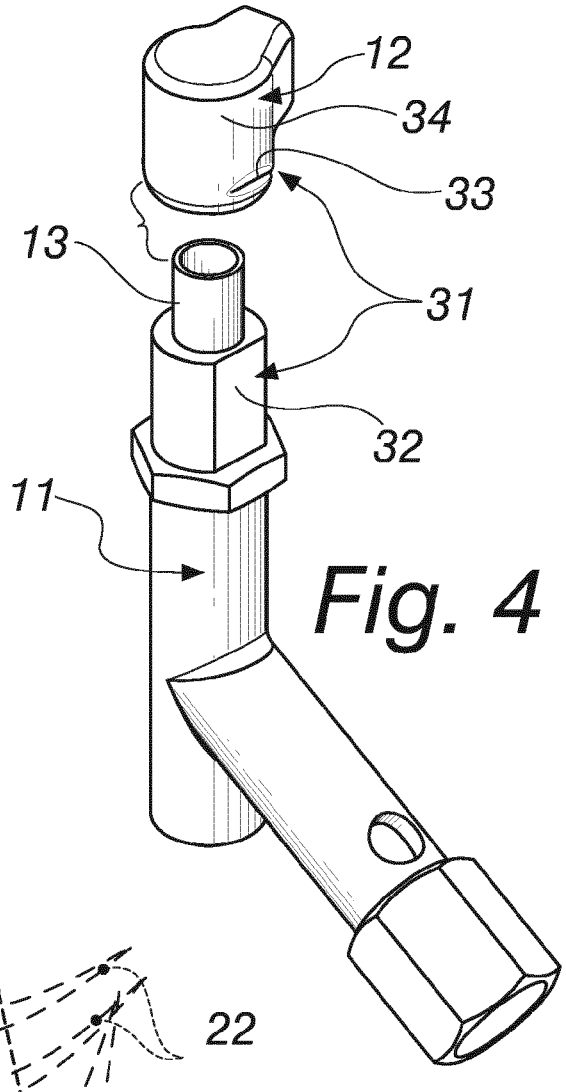
FIG. 4 is another partially exploded perspective view of a part of the device according to the invention.

The positioning means 31, which are clearly visible in particular in the exploded view of FIG. 4, are constituted for example by a flat milling 32 provided on a circular sector of the end portion 13 and by a corresponding lateral flattening 33 of a cylindrical portion 34 of the cap 12, which renders it shaped complementarily to the flat milling 32.

Advantageously, the Venturi tube 11 comprises two portions: a first portion 19, at the end 13 of which there is the cap 12, and a second portion 20, by means of which the Venturi tube is associated with a source of gas and extends laterally with respect to an intermediate region 21 of the first portion 19.

The device 10 is associated with the gas-fired burner 29 so that the first portion 19 is arranged along the vertical direction and therefore said holes 16 are aligned vertically.

It is understood that in other embodiments, which are not all illustrated for the sake of simplicity, there can be a single hole 16 or there can be more than two holes, which can be aligned along other directions or might not be aligned.

Advantageously, the first portion 19 has, on the opposite side 23 with respect to the exit side of the combustible mix, a removable plug 24.

The cap 12 is provided with an element 25 for conveying a flame, therefore the pilot flame 18, toward the thermocouple 17, which at the same time protects it against any air currents.

Figure 3:
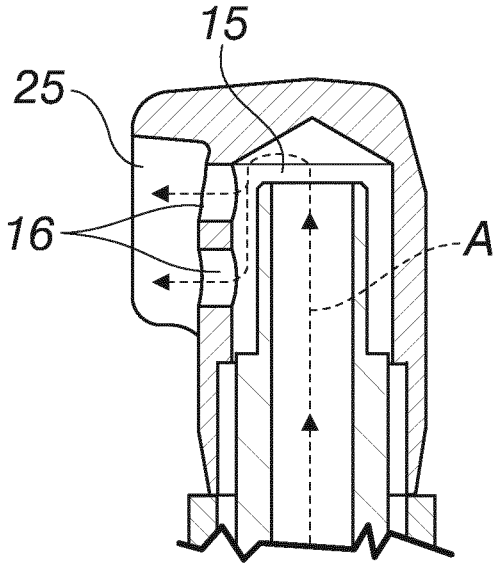
FIG. 3 is an enlarged-scale view of a detail of FIG. 2.

In particular, as shown in the enlarged-scale view of FIG. 3, the mix that arrives from the first portion 19 of the Venturi tube 11 exits from the holes 16, following the complex path designated by the reference letter A.

The device 10 is further provided with means 26 for fixing to the supporting structure and with means 27 for connection to a source of gas from which the gas rises along the Venturi tube 11, entraining the oxidizing air aspirated through the intake holes 28.

Figure 5:
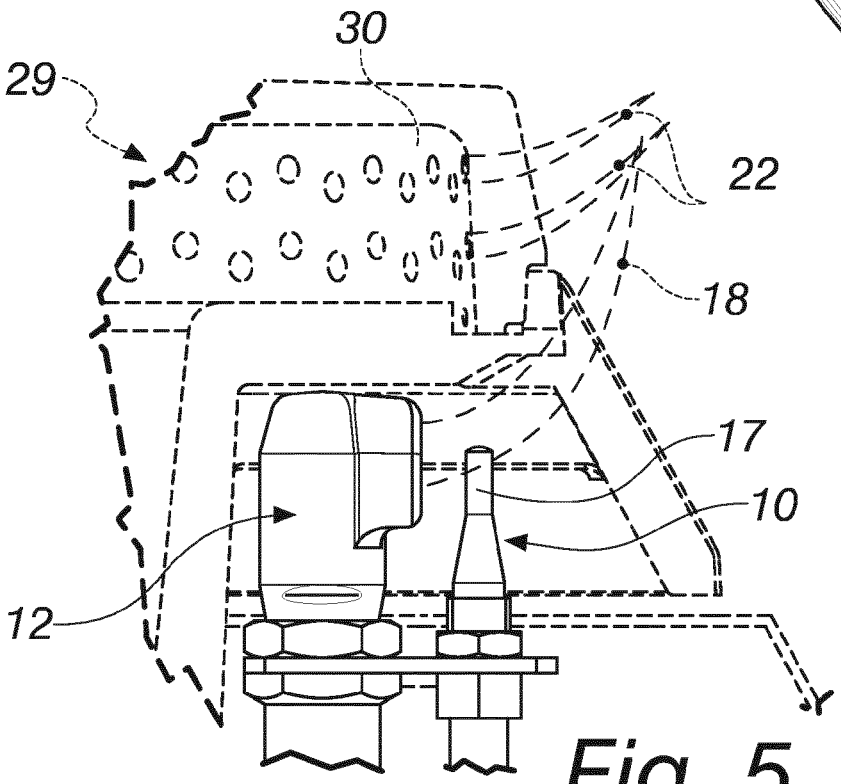
FIG. 5 is a detailed side view of a device associated with a gas-fired burner in cross-section.

The device 10 can be associated with the gas-fired burner 29, so that the pilot flame 18 is directed toward its flame separator 30, or, as shown in FIG. 5, it can be arranged below the gas-fired burner 29, so that the pilot flame 18 affects the flow of the combustible mix 22 in output from the flame separator 30 of the gas-fired burner 29.

Figure 7:
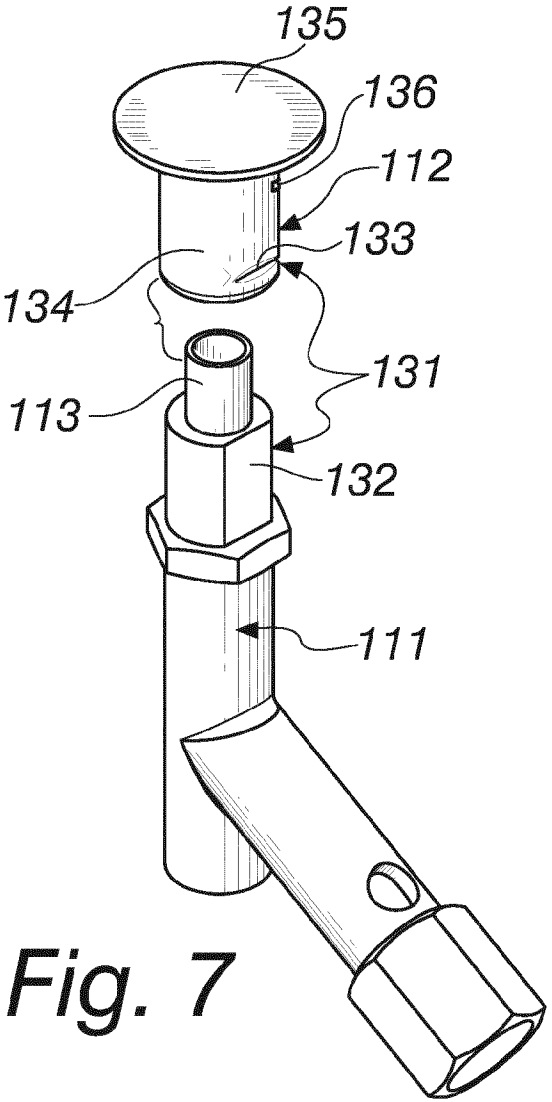
FIG. 7 is a view, similar to FIG. 4, of a part of the device in the second embodiment.
Figure 6:
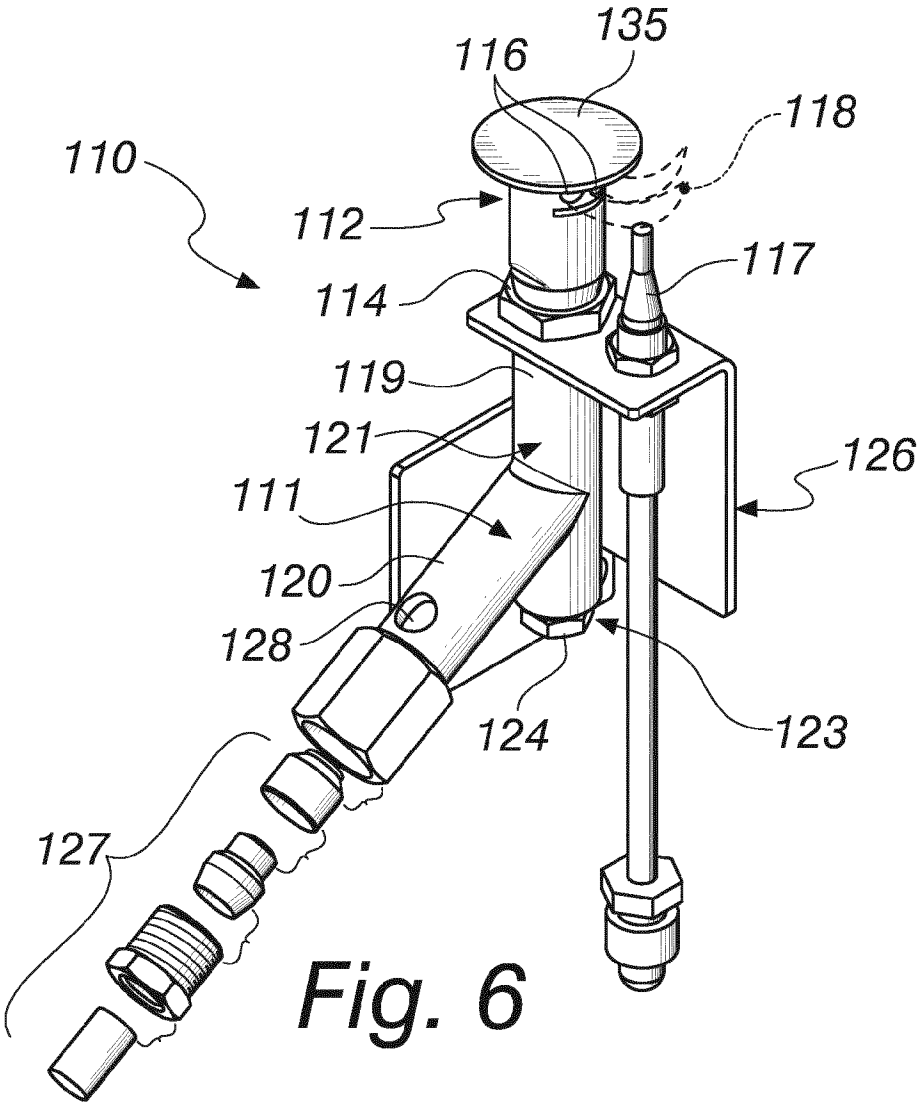
FIG. 6 is a view, similar to FIG. 1, of the device according to the invention in a second embodiment thereof.

Like the preceding one, in the second embodiment also the device 110, shown in FIGS. 6 and 7, comprises a Venturi tube 111 provided, at the part where the combustible mix exits, with a cap 112, here too fitted removably on an end portion 113 of the Venturi tube 111 and rested on the shoulder 114, so as to be spaced axially from the end portion 113.

This embodiment is substantially an equivalent version of the device 10 and has, with respect to it, three holes 116 (which in other embodiments might be present in a different number), are aligned horizontally and are protected in an upward region by a disk-like element 135 that is arranged at the end of the cap 112 and prevents the extinguishing of the pilot flame 18 as a consequence of any spillage of liquids.

Moreover, the device 110, differently from the preceding one, has on the cap 112, in addition to the holes 116, a horizontal slit 136 arranged below the three holes 116.

Also in a manner similar to the first embodiment, the cap 112 is fitted on the end portion 113 with an orientation that is defined by the positioning means 131, which are constituted by the flat milling 132 and by the corresponding lateral flattening 133 of the cylindrical portion 134, which are clearly visible in FIG. 7.

In this case also, the Venturi tube 111 comprises a first portion 119, from the intermediate region 121 of which a second portion 120 extends laterally, and the first portion 119 is again closed on the opposite side 123 with respect to the side from which the combustible mix exits with a removable plug 124.

The device 110 is further conveniently provided, like the preceding device, with means 126 for fixing to the supporting structure and with means 127 for connection to a source of gas, from which the gas rises along the Venturi tube 111, entraining the oxidizing air aspirated through the intake holes 128.

Operation of the device in the first embodiment of the invention is as follows.

Operation of the device in the second described embodiment is similar to it.

The combustible mix, rising along the Venturi tube 11, reaches the end portion 13, from which it exits, following the complex path A in the interspace 15 in order to exit from the holes 16, where the pilot flame 18 detected by the thermocouple 17 is formed.

It should be noted that the complex path A defines a forced path for the combustible mix, which in the opposite direction hinders the passage of dirt particles.

Moreover, the device 10 can be cleaned easily, ensuring always an effective flow of the mix to the holes 16.

Thanks to the removable cap 12 it is in fact possible to clean effectively both the cap 12 proper and the first portion 19 of the Venturi tube 11 from the particles of dirt or from any deposits caused by the spillage of liquids.

It should also be noted that the proposed solution allows to free from dirt and residues the Venturi tube 11 also on the side 23 that is opposite the side from which the combustible mix exits: by removing the removable plug 24 it is possible to complete the cleaning by inserting a brush or other similar means in the tube.

Moreover, it is important to note that the presence of at least two holes 16 ensures that the device 10 continues to operate correctly if one of the two holes is blocked.

Moreover, advantageously the flame conveyor 25, in addition to directing the pilot flame 18, protects it against any air currents or against the spillage of liquids that might extinguish it, and so does the disk-like element 135 in the second embodiment.

In practice it has been found that the invention achieves the intended aim and objects, by providing an igniter with pilot flame which, by facilitating the conditions required for the passage of the mixture of gas to the holes and thus the persistence of the pilot flame, ensures the correct operation of the main burner.

The invention thus conceived is susceptible of numerous modifications and variations, all of which are within the scope of the appended claims; all the details may further be replaced with other technically equivalent elements.

In practice, the materials used, so long as they are compatible with the specific use, as well as the contingent shapes and dimensions, may be any according to requirements and to the state of the art.

The disclosures in Italian Patent Application No. PD2012A000211 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. An igniter with pilot flame, particularly for gas-fired burners, comprising a Venturi tube provided, at the part where a combustible mix exits, with a cap which is fitted detachably and with play on an end portion thereof, from which said cap is spaced axially, at least one hole being provided on said cap and being transverse to said end portion, for the outflow of said combustible mix, and an orientation of said cap with respect to said end portion being such that said pilot flame affects the flow of the combustible mix that exits from a flame separator of said gas-fired burner and ignites it, said Venturi tube comprising a first portion, at an end of which said cap is present, and a second portion, by means of which said Venturi tube is associated with a gas source, which is extended laterally with respect to an intermediate region of said first portion, said first portion having, on an opposite side with respect to the exit side of said combustible mix, a removable plug, wherein said orientation is defined by means for positioning said cap which are designed to prevent its rotation with respect to said end portion on which it is fitted.

2. The device according to claim 1, wherein said means for positioning said cap are constituted by a flat milling provided on a circular sector of said end portion and by a corresponding lateral flattening of a cylindrical portion of said cap, which makes it shaped complementarily to said flat milling.

3. An igniter with pilot flame, particularly for gas-fired burners, comprising a Venturi tube provided, at the part where a combustible mix exits, with a cap which is fitted detachably and with play on an end portion thereof, from which said cap is spaced axially, at least one hole being provided on said cap and being transverse to said end portion, for the outflow of said combustible mix, and an orientation of said cap with respect to said end portion being such that said pilot flame affects the flow of the combustible mix that exits from a flame separator of said gas-fired burner and ignites it, said Venturi tube comprising a first portion, at an end of which said cap is present, and a second portion, by means of which said Venturi tube is associated with a gas source, which is extended laterally with respect to an intermediate region of said first portion, said first portion having, on an opposite side with respect to the exit side of said combustible mix, a removable plug, wherein said cap is spaced axially from said end portion, being fitted thereon so as to rest on an underlying shoulder of said Venturi tube, creating a siphon-shaped path for the combustible mix.

4. An igniter with pilot flame, particularly for gas-fired burners, comprising a Venturi tube provided, at the part where a combustible mix exits, with a cap which is fitted detachably and with play on an end portion thereof, from which said cap is spaced axially, at least one hole being provided on said cap and being transverse to said end portion, for the outflow of said combustible mix, and an orientation of said cap with respect to said end portion being such that said pilot flame affects the flow of the combustible mix that exits from a flame separator of said gas-fired burner and ignites it, said Venturi tube comprising a first portion, at an end of which said cap is present, and a second portion, by means of which said Venturi tube is associated with a gas source, which is extended laterally with respect to an intermediate region of said first portion, said first portion having, on an opposite side with respect to the exit side of said combustible mix, a removable plug, provided with two of said holes, which are aligned in the same direction of extension as said end portion.

5. An igniter with pilot flame, particularly for gas-fired burners, comprising a Venturi tube provided, at the part where a combustible mix exits, with a cap which is fitted detachably and with play on an end portion thereof, from which said cap is spaced axially, at least one hole being provided on said cap and being transverse to said end portion, for the outflow of said combustible mix, and an orientation of said cap with respect to said end portion being such that said pilot flame affects the flow of the combustible mix that exits from a flame separator of said gas-fired burner and ignites it, said Venturi tube comprising a first portion, at an end of which said cap is present, and a second portion, by means of which said Venturi tube is associated with a gas source, which is extended laterally with respect to an intermediate region of said first portion, said first portion having, on an opposite side with respect to the exit side of said combustible mix, a removable plug, wherein said cap is provided with an element for conveying the flame toward a thermocouple which faces said at least one hole.

6. An igniter with pilot flame, particularly for gas-fired burners, comprising a Venturi tube provided, at the part where a combustible mix exits, with a cap which is fitted detachably and with play on an end portion thereof, from which said cap is spaced axially, at least one hole being provided on said cap and being transverse to said end portion, for the outflow of said combustible mix, and an orientation of said cap with respect to said end portion being such that said pilot flame affects the flow of the combustible mix that exits from a flame separator of said gas-fired burner and ignites it, said Venturi tube comprising a first portion, at an end of which said cap is present, and a second portion, by means of which said Venturi tube is associated with a gas source, which is extended laterally with respect to an intermediate region of said first portion, said first portion having, on an opposite side with respect to the exit side of said combustible mix, a removable plug, wherein said at least one hole is protected in an upper region by a disk-like element which is arranged at the end of said cap.

* * * * *